US008474776B2

(12) United States Patent
Carroll

(10) Patent No.: US 8,474,776 B2
(45) Date of Patent: Jul. 2, 2013

(54) ANTENNA LEVELING SYSTEM

(76) Inventor: Rodney Carroll, Baltimore, MD (US)

( * ) Notice: Subject to any disclaimer, the term of this patent is extended or adjusted under 35 U.S.C. 154(b) by 675 days.

(21) Appl. No.: 12/768,827

(22) Filed: Apr. 28, 2010

(65) Prior Publication Data

US 2011/0267242 A1 Nov. 3, 2011

(51) Int. Cl.
*H01Q 1/34* (2006.01)
*H01Q 3/00* (2006.01)

(52) U.S. Cl.
USPC ..... 248/371; 343/709; 343/757

(58) Field of Classification Search
USPC ..... 343/709, 757, 763, 874, 878, 880, 343/890, 894; 248/371, 393, 397, 398, 424, 248/425, 542; 285/265, 121.7, 369, 184; 403/84, 92, 95, 97, 103, 104, 106; 74/484 R, 74/485, 491, 493
See application file for complete search history.

(56) References Cited

U.S. PATENT DOCUMENTS

| | | | | |
|---|---|---|---|---|
| 4,209,789 | A * | 6/1980 | Snedkerud | 343/765 |
| 4,659,044 | A | 4/1987 | Armstrong | |
| 5,154,386 | A | 10/1992 | Heck | |
| 6,097,344 | A * | 8/2000 | Anderson | 343/709 |
| 2007/0065319 | A1 * | 3/2007 | Hommann et al. | 417/477.1 |

OTHER PUBLICATIONS

SCANTRUST, Scanstrut Self Leveling Radar Pole Mount, see website link: http://www.jamestowndistributors.com/userportal/show_product.do?pid=53896&familyNa, Aug. 9, 2010.

EDSON, Brochure comprising: Mast-Mount Antenna Platforms, NavCom Tower Systems, NavCom Tower Components (step 1-3), NavCom Tower Accessories (step 4), (4 pages), Supplied By; American Rigging Supply, Inc.

SCANTRUST, Scanstrut LMM-3 Self Leveling Radar Mount-Mast-LMM-3, (4 pages), http://www.anchorexpress.com/ProductDetails.asp?ProductCode=LMM-3, Aug. 9, 2010.

* cited by examiner

*Primary Examiner* — Jacob Y Choi
*Assistant Examiner* — Scott Petersen
(74) *Attorney, Agent, or Firm* — Ober, Kaler, Grimes & Shriver; Royal W. Craig

(57) ABSTRACT

An apparatus for manually maintaining the level of a radar antenna mounted on a stern pole affixed to the deck or transom of a vessel providing a platform pivotably mounted to a distal end of the pole and oriented to rotate about an axis substantially parallel to the centerline of the vessel. A controller at the lower end of the pole proximal to the cockpit permits manual adjustment of the horizontal angle of the radar antenna to maintain level due to heeling of the boat. The controller utilizes a first plate secured to the pole having a series of detent positions angularly spaced around and equidistant from a center point and a second plate rotatably secured at the center point. A grip handle projecting from the front surface of the second plate permits rotation of the plate when a cooperatively aligned release handle is grasped to withdraw one or more pins extending through holes in the second plate engage the detent positions. A pair of cable or rod linkages transmit rotation of the second plate to the antenna mounting platform.

17 Claims, 9 Drawing Sheets

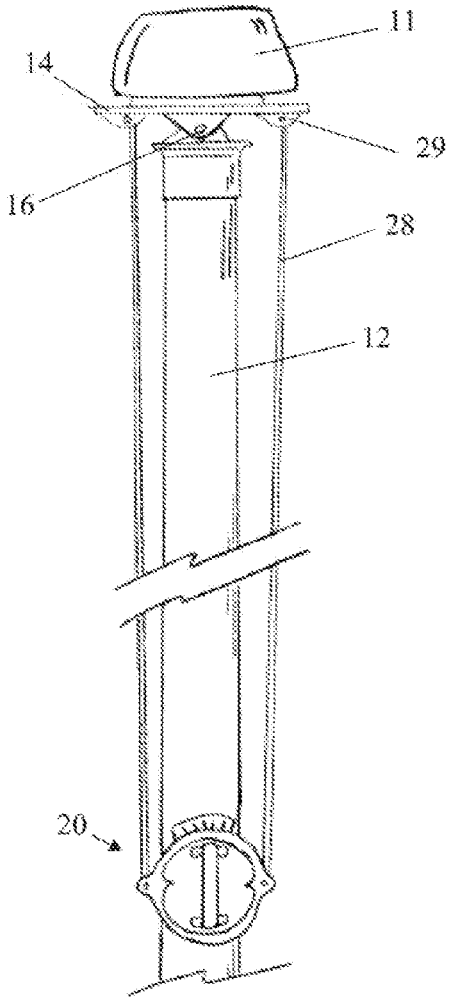
FIG. 3A
FIG. 3B
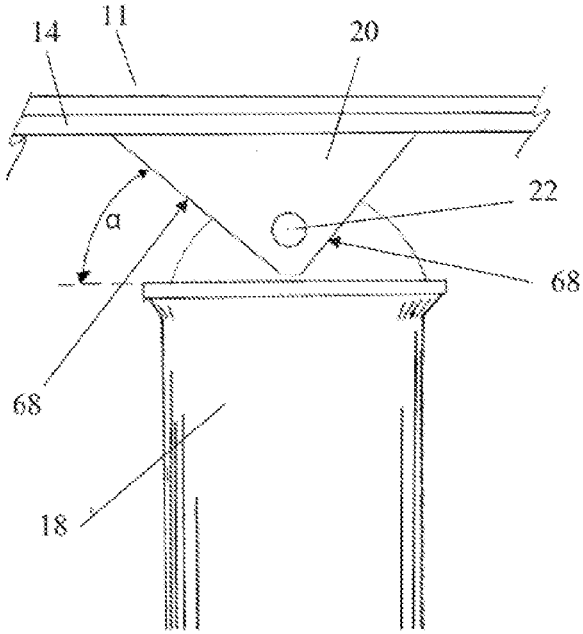

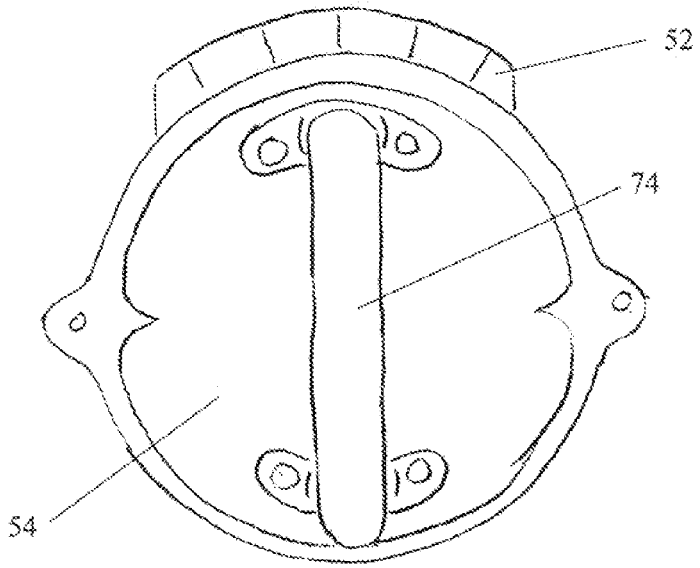
FIG. 6
FIG. 7
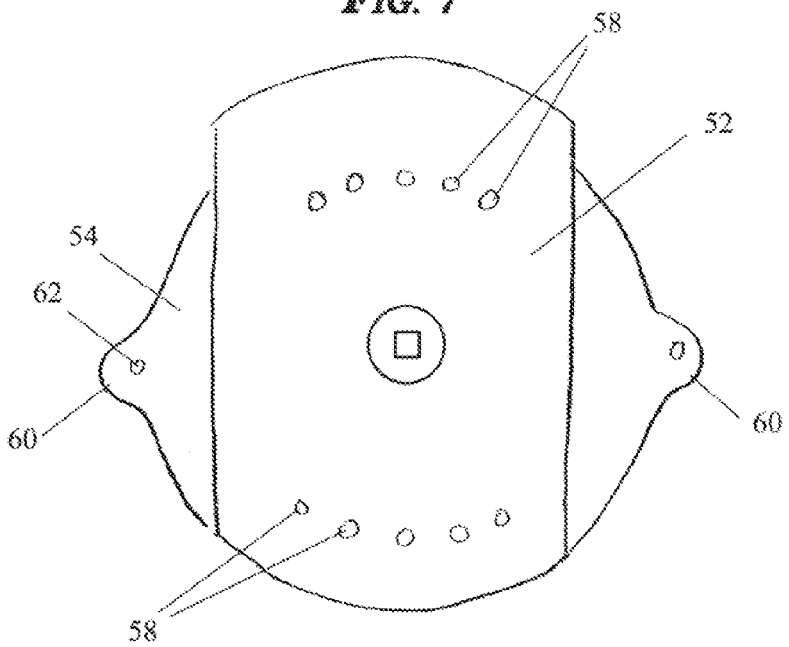

ANTENNA LEVELING SYSTEM

BACKGROUND OF THE INVENTION

1. Field of the Invention

The present invention relates generally to a system for mounting equipment such as a transceiver antenna unit to a vehicle. More specifically, the present invention is directed to a system and apparatus for manual adjustment of the antenna unit and mast orientation relative to a moving boat to maintain a generally horizontal orientation of the equipment relative to an external frame of reference.

2. Description of the Background

Marine radar equipment has become increasingly easy and inexpensive to use and consequently is found on more and more small vessels including small sailboats. As is well known, marine radar systems detect objects such as other vessels or land masses at or near the surface of the water by transmitting radio waves or microwaves and detecting the return wave signal that is reflected by objects in their path. In order to provide information about objects in a wide area, radar systems typically use rotating antennas to sweep an arc in the horizontal plane H (FIG. 1A, 1B) partially or completely around the vessel while continually scanning for returned radio signals indicating the presence of an object. The range at which a radar system is capable of detecting the signal returned by an object is increased by elevating the antenna such that it is common to mount the antenna to the mast of a sailboat or to another point in the rigging above the deck in order to maximize operational range.

However, under sail a sailboat may be heeled over at an angle that can reach 45° or more in heavy winds, and 15° to 25° degrees under more common wind conditions. When a sailboat is heeled over the normally horizontal plane swept by a rotating antenna is likewise tipped or heeled to a similar angle, as depicted in FIG. 1B. On the leeward or downwind side of the boat the radar signal is directed downward toward the water's surface, where it is reflected or deflected resulting in false or distorted return signals. On the windward side the radar signal is directed upward, well above any objects of concern for the sailor resulting in no return signal at all. In either case the effective range and ability of the radar system to detect objects at or near the surface of the water in proximity to the vessel is severely compromised. The vertical beam width of the transmitted radar signal is typically 25° such that any heel angle over 12.5° will negatively impact radar performance.

Mounting devices for radar antennae have been provided previously for use on sailing vessels. Some mounting devices such as that described in U.S. Pat. No. 4,659,044 to Armstrong fix the position of the radar antenna and do not facilitate any pivotal movement to compensate for heeling. More recently, prior radar mounts such as that described in U.S. Pat. No. 5,154,386 have included a pivoting system which allows the mounted radar antenna to swing freely and assume a horizontal orientation under the force of gravity. Other prior art radar mounts such as is described in U.S. Pat. No. 6,097,344 to Anderson utilize an actuator system to actively level a radar antenna mount.

Each of these prior radar antenna mounting devices has drawbacks and limitations. For example, fixed radar antenna mounts allow radar systems to be used in only the calmest conditions with minimal heeling of the sailboat, as described above. Gravity oriented pivoting radar antenna mounting devices allow the radar antenna to swing freely and constantly as the vessel moves through the waves (and even at anchor) negatively impacting the accuracy of the radar system and excessively wearing the antenna connections and electrical cabling as well as the moving parts of the mount itself. Passive dampening elements may somewhat limit swinging but add complexity and expense to the system, require maintenance and are prone to wear and malfunction under marine conditions. Actively actuated (motorized) systems eliminate the wear associated with uncontrolled swinging but require power and control systems which are equally prone to wear and failure in a marine setting.

Typically, wind conditions remain fairly constant on a minute to minute basis and a sailboat tends to heel at a constant angle or range while sailing in a given direction. Thus, it is unnecessary to constantly adjust the radar antenna. It is sufficient, and much easier, to adjust the angle once at each tack, and therefore more practical to provide a manual adjustment feature, thereby reducing wear and tear of cabling.

It would be desirable to provide a system for elevated mounting of radar antenna on a sailing vessel that is capable of being quickly and easily leveled manually by an operator and yet which avoids the limitations, cost, complexity and power requirements of prior systems and which also avoids the continuous and debilitating wear induced by uncontrolled swinging of the mount.

SUMMARY OF THE INVENTION

The present invention is, therefore, directed to a pole mounting device for a marine radar antenna that overcomes the foregoing deficiencies and others associated with prior mounting systems. The present invention provides an apparatus for manually maintaining the level of a radar antenna mounted on the top-end of a stern pole affixed to the deck or transom of a sailing vessel. The radar antenna is mounted atop a platform, and the platform is pivotably mounted on the top-end of the stern pole oriented to rotate about an axis substantially parallel to the centerline of the vessel as the vessel heels in varying wind conditions. A controller at the lower end of the pole proximal to the cockpit permits manual adjustment of the horizontal angle do the radar antenna to maintain level of the platform due to heeling of the boat. The controller is a heavy-duty unit permitting rapid and convenient angular and locking adjustment of the angle of the platform (and thus the antenna).

The controller utilizes a first plate secured to the pole having a series of detent holes angularly spaced around and equidistant from a center point, and a second plate rotatably secured to the first plate at the center point. A grip handle projects from the front surface of the second plate. The grip handle carries a cooperating squeeze-type release handle beneath it which, when squeezed, withdraws a pair of detent pins from the detent holes in the first plate. Thus, squeezing the release handle withdraws the detent pins extending through holes in the second plate permitting leveraged rotation of the second plate relative to the first. Relaxing the release handle re-engages the detent pins and locks the second plate in position. A pair of cable or rod linkages transmit rotation of the second plate to the antenna mounting platform at the distal end of the pole. Where cable linkages are utilized one or more sheaves may be used to route the cable path from the controller to the platform. A side mount bracket for the platform permits installation of a second, fixed antenna or device over the end of the pole.

The device allows an operator to quickly and easily adjust the angle of the radar antenna manually at each tack to a proper horizontal angle, and therefore reduces wear and tear on cabling, eliminates noise, and avoids the limitations, cost, complexity and power requirements of prior art systems.

DESCRIPTION OF THE DRAWINGS

The objects, features, and advantages of the present invention will become apparent from the following detailed description of the preferred embodiments and certain modifications thereof when taken together with the accompanying drawings in which like numbers represent like items throughout and in which:

FIG. 3A is an elevation of a radar antenna mounted to a stern pole according to the present invention.

FIG. 3B is a partial detail view of the pivot of the antenna mounting platform according to the present invention.

FIG. 4B is an

FIG. 6 is a front elevation view of a control handle.

FIG. 7 is a rear elevation view of a control handle.

DETAILED DESCRIPTION OF THE PREFERRED EMBODIMENT

Figure 1A:
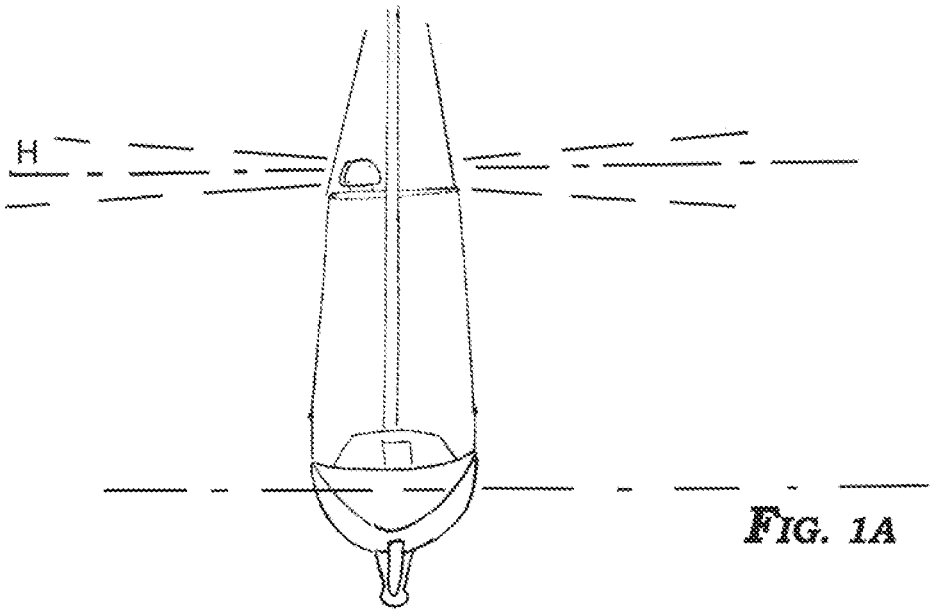
FIG. 1A is a diagram of a radar equipped sailboat at rest.
Figure 1B:
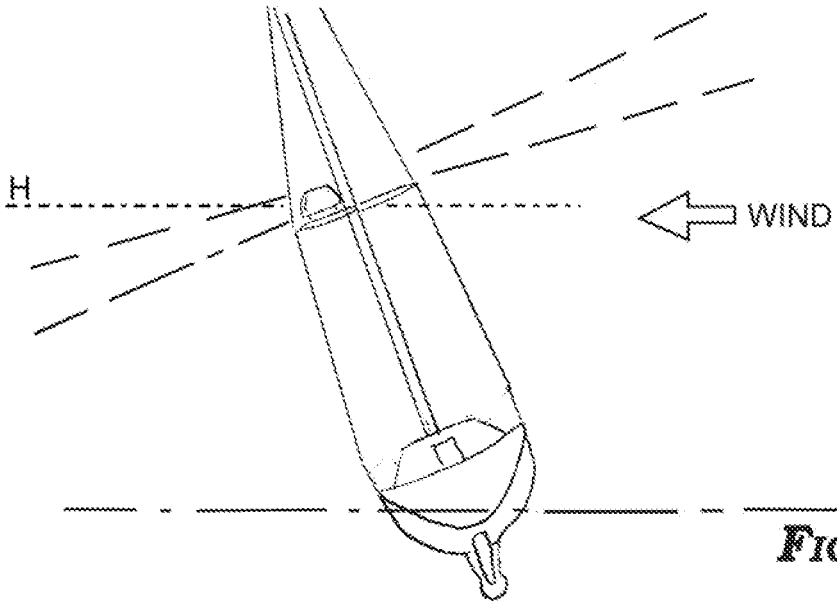
FIG. 1B is a diagram of a radar equipped sailboat heeled over in the wind.

For the purposes of promoting an understanding of the principles of the invention, reference will now be made to the exemplary embodiment illustrated in the drawings and described below. The embodiment disclosed is not intended to be exhaustive or limit the invention to the precise form disclosed in the following detailed description. Rather, the embodiment is chosen and described so that others skilled in the art may utilize its teachings. It will be understood that no limitation of the scope of the invention is thereby intended. The invention includes any alterations and modifications in the illustrated device, the methods of operation, and further applications of the principles of the invention which would normally occur to one skilled in the art to which the invention relates.

Figure 2:
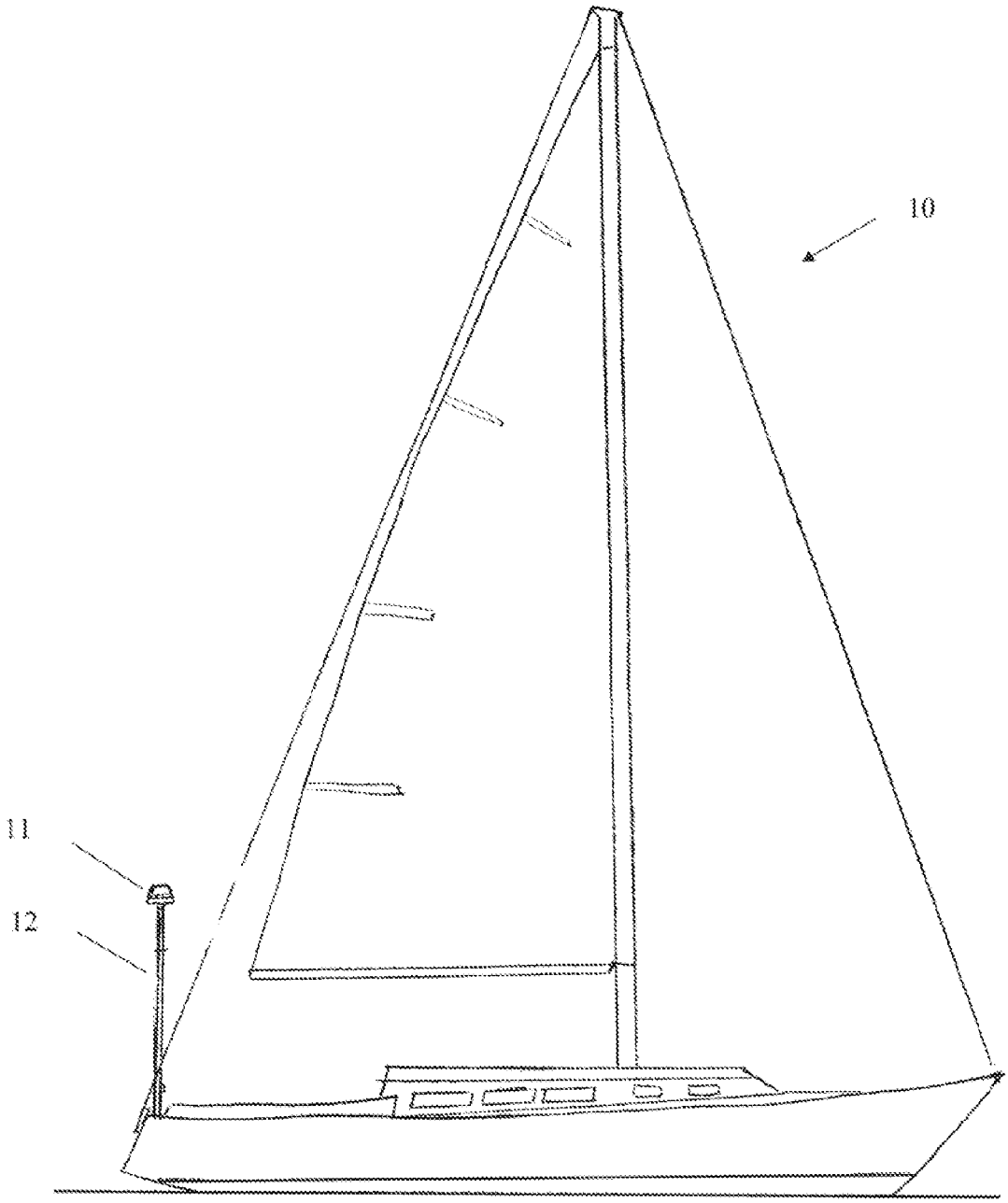
FIG. 2 is a is a side view of a sailboat having a radar antenna mounted to a stern pole

With reference to FIG. 2, a typical small sailboat 10 is shown having a radar antenna dome 11 mounted to a pole 12 at the stern of the vessel to increase its height above the water without attaching it directly to the mast or rigging where it may interfere with or be damaged by the sails. Such poles are known in the art and are typically six to 9 feet in height, 2 or 3 inches in diameter and may be made from aluminum, stainless steel or carbon. Mounting of such poles to the deck or transom of a boat is also well known in the art and is generally accomplished by a fitting secured to the deck or transom and to which the pole end is affixed by insertion, a pin or the like. A bracket and standoff may be used to brace the pole against a deck rail or deck support strut.

Figure 3C:
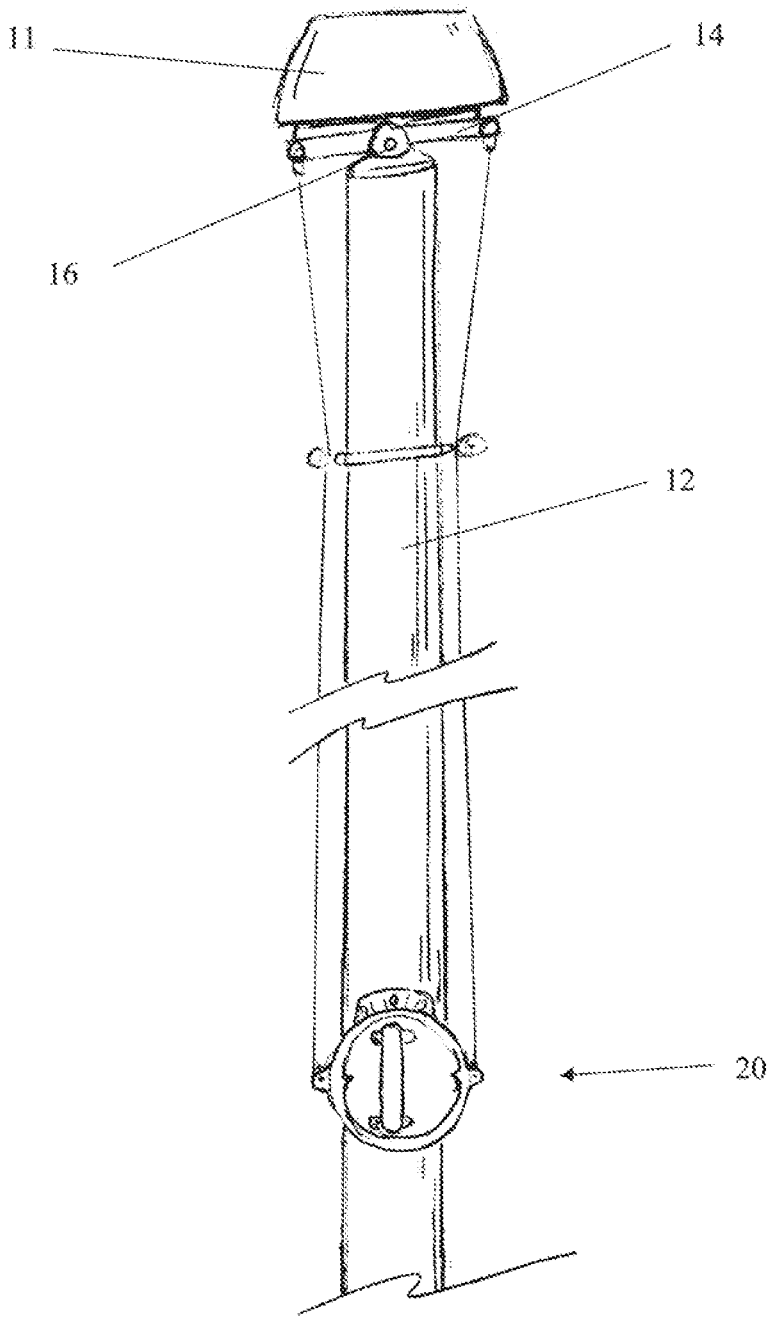
FIG. 3C is an elevation of a radar antenna mounted to a stern pole according to an alternate embodiment of the present invention.

With reference to FIGS. 3A and 3C, a stern pole 12 as described and equipped with the present invention is depicted, looking directly astern. At or near the top of the pole 12 is mounted a radar antenna dome 11 as is commonly provided to house marine radar antennas to protect them from the elements. In accordance with the present invention, the dome 11 is mounted on a bracket or platform 14 that is pivotably mounted about an axis that is substantially parallel to the centerline of the vessel 10. A controller 20 is provided at the base of the pole for controlling the direction and degree of pivot of platform 14 by an operator in or near the cockpit of the vessel. The term platform as used herein includes any means for mounting a radar dome 11 and may include a flat plate as depicted, a perforated plate, frame, bracket, rail or other rigid member suitable to receiving and supporting the radar dome.

Figure 4A:
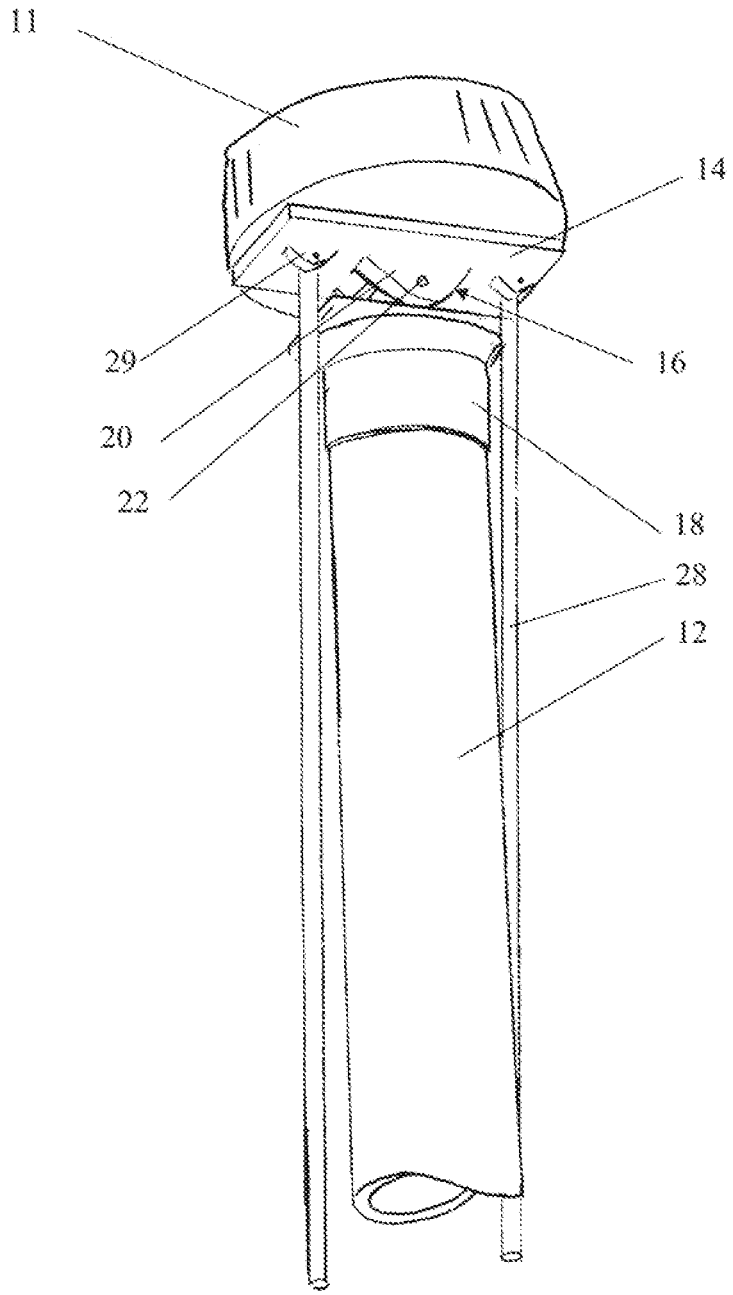
FIG. 4A is a detailed partial perspective view if radar antenna mount to the top of a stern pole according to the present invention.
Figure 4B:
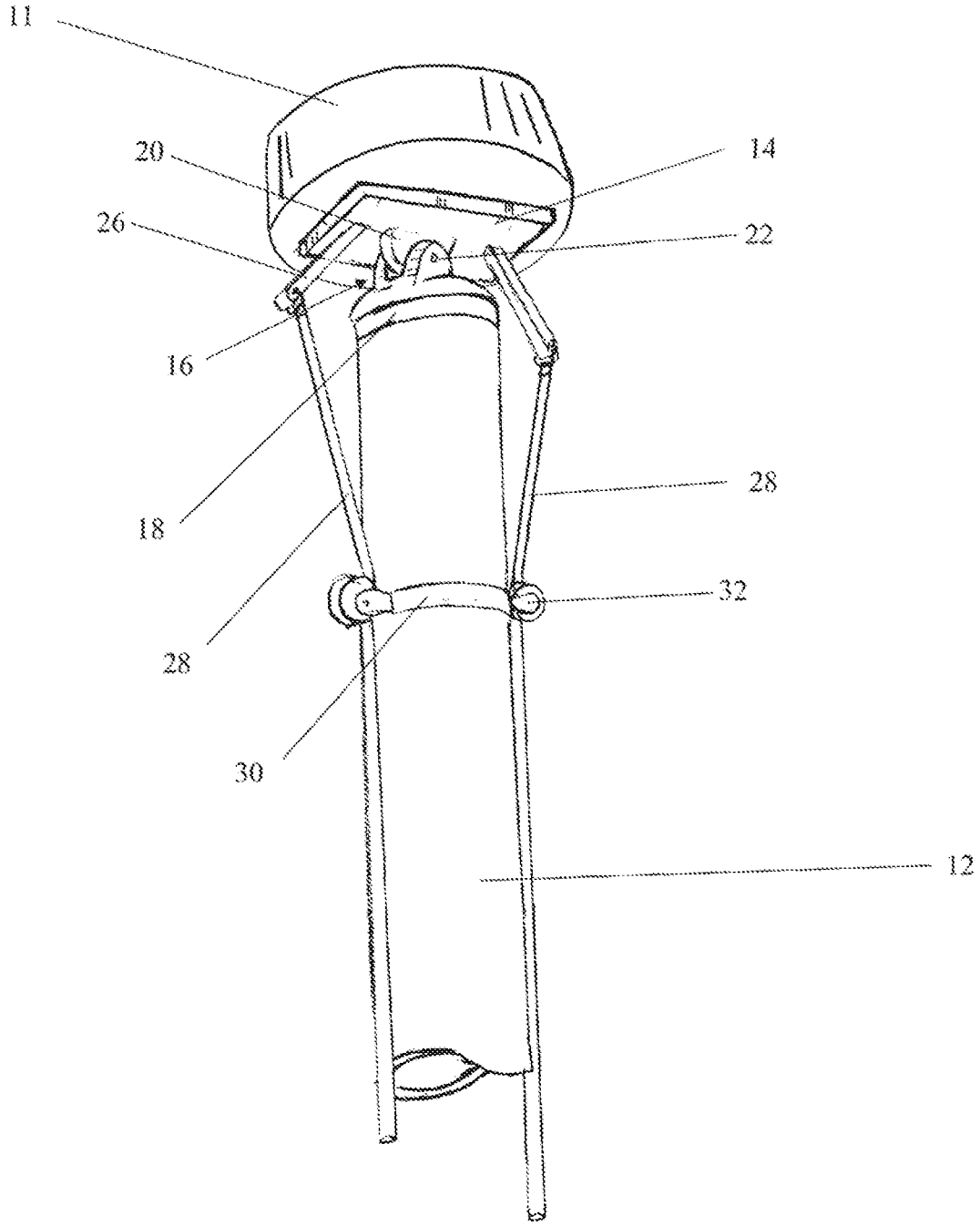

With additional reference to FIG. 4A, in a preferred embodiment the platform 14 is mounted directly atop the pole 12 on a pivot 16. Pivot 16 preferably includes a series of cooperating hinge knuckles 20 affixed to both the platform 14 and pole cap 18 and joined through aligned holes by a barrel or pin 22. A tab 29 is preferably provided at or near the lateral extremities of the platform 14 on either side of the pivot 16 to which the control system 20 is directly linked to control rotation of the platform about the pivot 16. In an alternate embodiment (FIG. 4B), a control arm 26 may be provided at the lower side of the platform 14 on either side of the pivot 16 to increase the lateral distance of the tab 29 from the pivot 16 in order to gain mechanical advantage. The control arm 26 may be a single bar or rod of length greater than the width of the platform 14 positioned and fixed to the platform so as to extend laterally to both the port and starboard sides an equal distance in a generally horizontal orientation. Alternately a pair of separate control arms may be provided on either side in a horizontal or downward sloped configuration. The length of the control arms 26 is directly proportional to the mechanical advantage provided to the control system (as described below).

In another alternate embodiment the platform 14, while still mounted at the distal end of the pole 12, may be mounted fore or aft of the pole on a pivot mounted to the vertical external surface of the pole. For example, the pivot may be a horizontal shaft affixed to the pole 12 for insertion into a cooperatively formed bore in the opposing platform 14. The bore may include a bearing or bushing to minimize rotation friction of the shaft in the bore. In such an embodiment the control arms 26 would, in addition to extending directly to beam, extend fore or aft so as to terminate to beam of the pole itself in order to align with the linkages 28. It is preferable that the center of mass of the platform 14 and antenna be at or slightly below the rotational axis of the shaft. Fore or aft mounting of the platform 14 just below the pole cap frees the pole cap, allowing an additional stationary antenna to be mounted such as a satcom antenna or a light, camera, etc., Linkages 28 join the distal ends of the control arm 26 with the controller 20 at the base of the pole 12. Linkages 28 are preferably a flexible, non-stretching cable and more preferably marine grade high tensile 7×19 preformed stainless steel strand cable manufactured from type 302/304 stainless steel or other marine grade stainless steel. When made from stainless steel cable the linkage 28 is preferably 1/16" to 3/16" diameter and more preferably 1/8" diameter. Linkages 28 may, in an alternate preferred embodiment, be constructed of rigid rod or bar stock which provides a level of redundancy in as much as a single bar can both push and pull the platform 14 to pivot in both directions about the pin 16. However, the rigidity of the rod/bar construction renders it susceptible to plastic deformation (bending) if impacted without the ability to recover its shape, thereby potentially rendering the system inoperative.

Linkages formed of flexible cabling avoid this drawback but lack redundancy in as much as both cable linkages are required for operation of the device. Cable linkages 28 are also significantly easier to manufacturer at custom lengths utilizing swaged end fittings such as Lifeline T Style Toggle Jaws or Tubular Lifeline Jaws by the C. Sherman Johnson Co. Inc.(East Haddam, Conn.), rigging pins or through bolts. Cable linkages are likewise easier and less expensive to ship by common carrier.

In a preferred embodiment utilizing cable linkages, one or more guide collar 30 may be provided along the pole to position and guide the linkages. The guide collar 30 positions a sheave or turning block 32 on both the port and starboard sides of the pole 12 and may be positioned nearer to the pole cap or to the controller depending on the geometry of the system. Where a single guide collar is provided it is preferable to position it near the midpoint of the pole such that the cable linkages form an hourglass shape. Alternately, an upper and lower guide collar may be used simultaneously. The blocks of the guide collar allow the wire linkages 28 to run in close proximity to the pole 12 below (or between) the collar(s) and to splay outward to meet the distal ends of the tabs 29. The guide collar 30 may include a band or compression member around the pole 12 to which to affix the blocks 32. Alternately, the blocks may be affixed directly to the pole 12 by mechanical fasteners or other means. Where the linkages are rod or bar members the guide collar and blocks are omitted and the linkages run directly from the controller 20 to the tabs 29 as in FIG. 4A.

With reference to FIGS. 3 and 5 through 8, a controller 20 is positioned at the proximal end of the pole above the deck so as to be accessible from the deck or cockpit of the vessel. The controller 20 has a planar back plate (as will be described) that that may be mounted to the circular pole 12 by means of one or more split ring mounting brackets 97 or similar bracket adapted to provide a flat surface or area on which to mount the controller. Alternately, the back plate 52 my be formed with a concave portion for cooperative engagement with the surface of the pole 12 and directly mounted thereto by mechanical means (not visible). The back plate 52 is generally planar in form having a width approximately equal to or slightly greater than the width of the pole 12 to which it is mounted. The lateral edges of the back plate 52 are preferably truncated so as to permit the lobes of the front plate (as described below) to extend beyond the edges of the back plate. The upper and lower edges of the back plate are preferably arcuate in form and, in the case of the upper edge, extend beyond the upper edge of the front plate so as to provide an index against which to measure rotation of the front plate relative to the back plate.

A hole (obscured) is provided though the back plate at its approximate center though which a post 53 is secured to rotatably affix a front plate 54 to the back plate 52. The post 53 may be threaded on its distal end and secured by a plurality of washers and a nut behind the back plate or by other mechanical means that permit relative rotation of the plates. A spacer or bushing (obscured) of nylon or other suitable material is provided between the front plate 52 and back plate 54 around the post 53 to facilitate smooth rotation of the front plate 52 and to eliminate play between the plates. A plurality of additional holes 58 serving as detent positions (as will be described) are additionally provided though the back plate 54. Detent holes 58 are arranged in opposing arcs about the center of rotation of the front plate 52 relative to the back plate (i.e. post 53) and spaced at regular angular intervals. In the depicted embodiment the detent holes are provided at 15 and 30 degrees on either side of center and the index is marked to indicate such intervals. With reference to FIG. 3B, hinge knuckles 20 are preferably formed so as to present a bearing surface 68 for contacting the pole cap 18 when the platform has been rotated 1 to 2 degrees past the maximum detent position on either side of center. Consequently, the knuckle 20 is shaped on each side to form an angle a that is 1 to 2 degrees greater than the maximum tilt of the platform or, in the depicted embodiment, 32 degrees. The contact of the bearing surface with the pole cap acts as a positive rotational stop to prevent the linkages from binding against the controller due to over rotation of the front plate.

The front plate 54 is generally circular in form and, as described, is rotatably affixed to the back plate 52. A pair of lobes 60 extend laterally from the edges of front plate 54 and are provided with through holes 62 to which the linkages 28 from the control arms 26 are attached. The linkages 28 are affixed to the through holes 62 (as well as to the control arms 26) by a pin, fitting, screw or other means that permits rotation of the connection. Lobes 60 are angularly spaced 180° from one another and are positioned in the horizontal plane when the controller is mounted and in the neutral position such that the platform 14 is level. The front and back plates 54, 52 are preferably made of stainless steel, aluminum, bronze, copper-nickel alloy or combinations thereof suitable for marine use. In certain embodiments aluminum elements may be powder coated. In certain other embodiments carbon fiber or other common boat building material having suitable strength and durability characteristics may be used.

Figure 5:
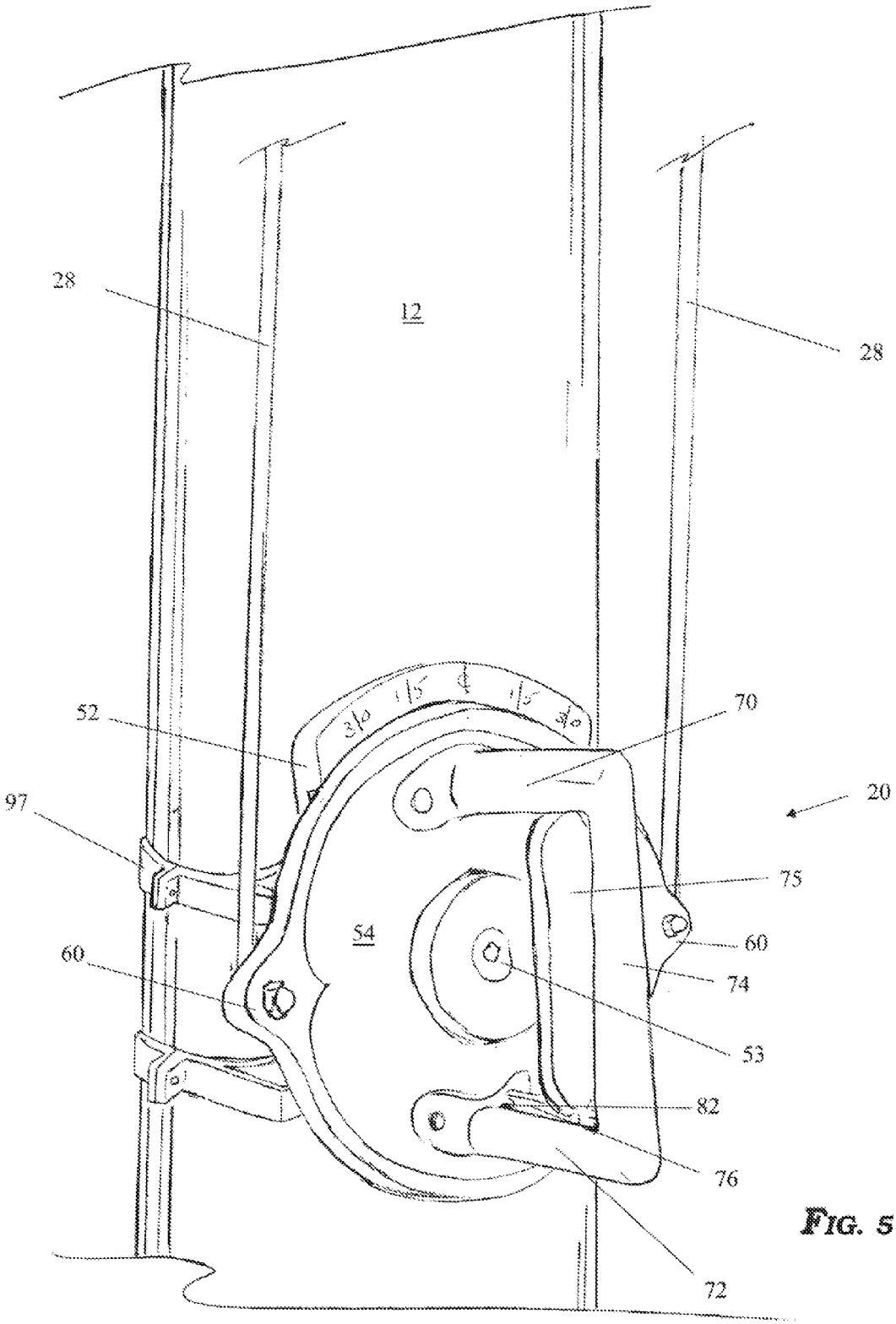
FIG. 5 is a detailed partial perspective view if a control handle according to the present invention.
Figure 8:
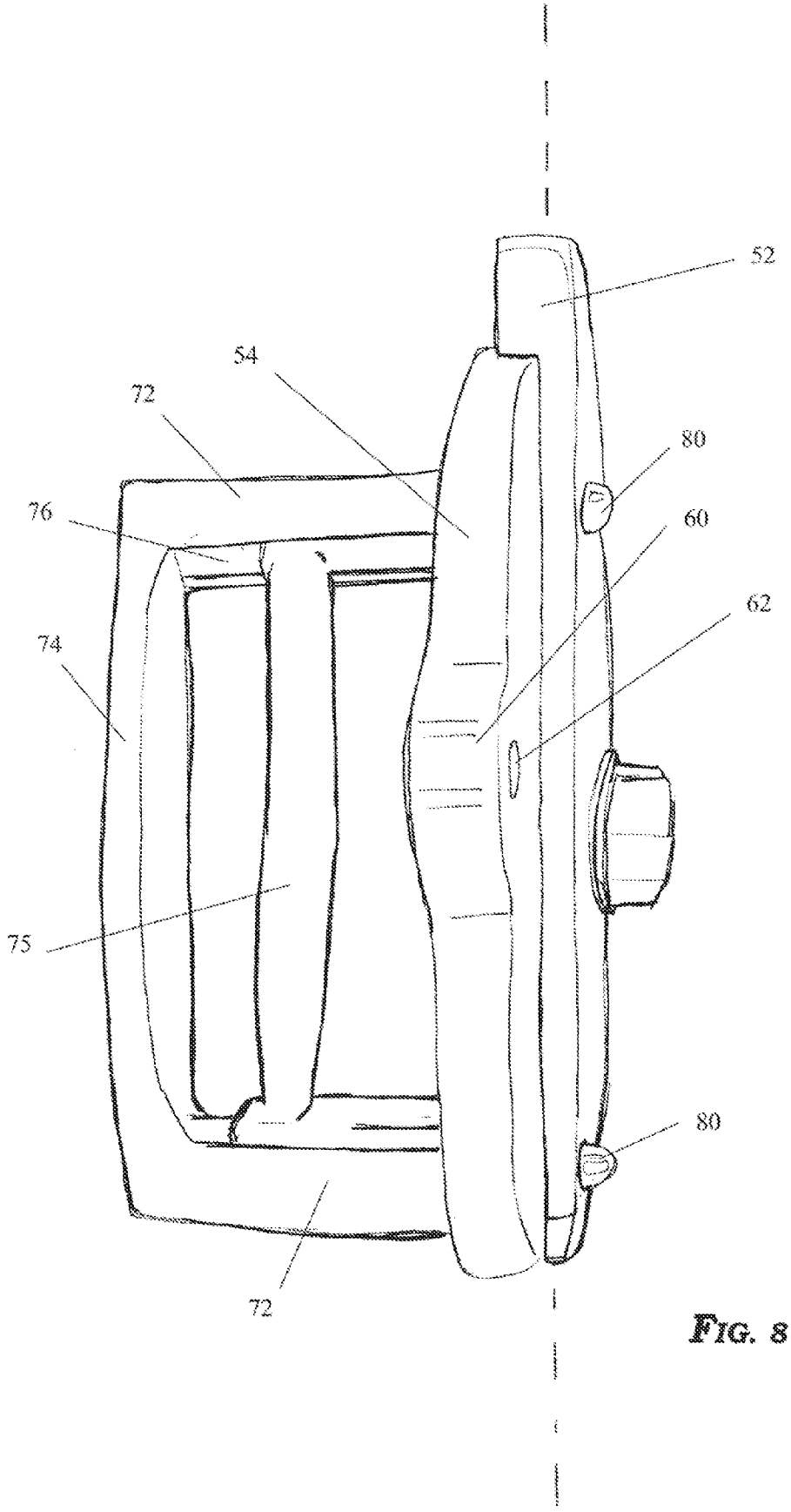
FIG. 8 is a partial side perspective of view of a control handle.

A fixed handle 74 is centrally mounted to the front surface of the front plate 54 and preferably positioned to be in a vertical orientation when the controller 20 is mounted and in the neutral position as depicted in FIG. 5. The upper and lower arms 70, 72 of the fixed handle project from the surface of plate and are preferably equally spaced from the center of rotation (i.e. post 53). A lateral member forming a grip joins the distal ends of the upper and lower arms 70, 72 to form the fixed handle 74, the center of which is directly over the center of rotation such that a user can grip the fixed handle with one hand and easily rotate the front plate 54 by rotation of the wrist. The inner surfaces of the upper and lower arms 70, 72 are characterized by a longitudinal recess or channel which serves as a track 76 for a moveable release handle 75. Similar to the fixed handle, the release handle 75 is made up of an upper and lower projecting arm rigidly connected by a lateral arm or release member. The upper and lower projecting arms of the release handle extend beyond the lateral member that joins them to provide a positive stop which prevents the lateral member of the release handle 75 from being drawn all the way into contact with the lateral member of the fixed handle 74 in order to avoid pinching the hand of the operator between handles during operation. The distal ends of the projecting arms of the release handle are each provided with a protruding pin 80 that extends through a cooperatively sized hole 82 through the front plate 54 at the end of the tracks 76. Holes 82 are radially positioned an equal distance from the center of rotation such that holes 82 align with a pair of the detent holes 58 in the back plate when the front plate is rotated to the proper orientation. A spring is provided in each track 76 to bias the release handle in the down or locked position in which the pins 80 extend through the front plate 54 and into the detent holes 58 preventing rotation of the front plate 54 relative to the back plate 52.

When rotation of the front plate 54 is desired the user grips the fixed handle 74 and simultaneously grips and squeezes the release handle 75, overcoming the biasing action of the springs and lifting the pins 80 from the detent holes 58. The user freely rotates the front plate 54 by action of the wrist via the fixed handle, releasing the release handle 75 when the front plate 54 is at or near the desired angle of rotation. The front face of the front plate 54 is preferably marked with angle indicia to visually assist in setting the proper angle. Upon release of the release handle 75 the springs again bias the pins 80 through the front plate 54 and further into the detent holes 58. If the detent holes 58 are not aligned with the holes 82 when the release handle is released the pins 80 will run along the surface of the back plate 52 offering little resistance to rotation and will simply fall into the next available detent holes 58 upon proper alignment.

In an alternate embodiment a single arm extends from the front surface of the front plate 54 supporting the grip handle 74 which may be parallel to or sloped away from the surface but is preferably aligned over the center of rotation in either case as above. A release handle 75 is pivotably mounted to the front plate 54 or the grip handle 74 and affixed to a spring biased pin 80 so as to withdraw the pin from the detent holes and permit rotation of the front plate 54 relative to the back plate 52 until the release handle 75 is released at which point the spring biases the pin 80 to re-engage the detent holes.

In use, a radar antenna is mounted to the platform 14 which is maintained in a level position when the vessel is at rest or otherwise in an upright (not heeled) position. The pins 80 are biased into the detent holes 58 and retain the front plate 54 in a fixed position which fixes the platform 14 via the linkages 28. Under sail, as the vessel heels over a user grips the grip handle 74 and simultaneously grasps the release handle 75 to overcome the biasing action of the springs to disengage the pins 80. Once free of the detents, the user can easily rotate the front plate 54 by rotating his wrist. Rotation of the front plate 54 causes the antenna platform 14 to similarly rotate via the linkages 28. When the platform 14 is leveled the user releases the release handle 75 and again secures the front plate 54 in place and likewise secures the platform 14 in place. On tacking or a change in the heel angle due to a change in course or wind conditions the user can easily and quickly adjust the platform 14 angle to re-level the antenna.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims and may be used with a variety of materials and components. This application is therefore intended to cover any variations, uses, or adaptations of the invention using its general principles. Further, this application is intended to cover such departures from the present disclosure as come within known or customary practice in the art to which this invention pertains.

I claim:

1. An apparatus for mounting a radar antenna to the deck or transom of a vessel, said apparatus comprising:

a pole for mounting to said deck or transom;

a platform pivotably mounted to a distal end of said pole and oriented to rotate about an axis substantially parallel to the centerline of the vessel;

a controller affixed to said pole at a proximal end, said controller comprising a first plate member fixedly secured to said pole having a plurality of detent positions angularly spaced around a center point;

a second plate member rotatably secured to said first plate member so as to turn about said center point;

a grip handle fixedly secured to and projecting from a front surface of said second plate member, said grip handle aligned with said center point a release handle moveably secured to said second plate member and comprising at least one pin extending through at least one hole in said second plate member to removably engage said detent positions when rotated so as to be aligned therewith, said pin spring biased into an engaged position and withdrawn to a disengaged position by motion of said release handle relative to said grip handle;

a first linkage affixed to a first edge of said second plate member and to said platform and a second linkage affixed to a second edge of said second plate member and to said platform whereby rotation of said second plate about said center point results in commensurate rotation of said platform about said axis.

2. The apparatus for mounting a radar antenna of claim 1 wherein said second plate further comprises a first lobe extending laterally there from to the port side of said vessel and a second lobe extending laterally there from to the starboard side of said vessel, said first linkage affixed to said first lobe and said second linkage affixed to said second lobe.

3. The apparatus for mounting a radar antenna of claim 2 wherein said first lobe and said second lobe are oriented in a horizontal plane and angularly spaced 180° from one another.

4. The apparatus for mounting a radar antenna of claim 1 wherein said first linkage and said second linkage are each comprised of a cable.

5. The apparatus for mounting a radar antenna of claim 1 wherein first linkage and said second linkage are each comprised of a rod.

6. The apparatus for mounting a radar antenna of claim 4 further comprising at least one guide collar, said guide collar comprising a first sheave affixed to a port side of said pole and a second sheave affixed to a starboard side of said pole, said first linkage cable passing through said first sheave and said second linkage cable passing through said second sheave.

7. The apparatus for mounting a radar antenna of claim 1 wherein said edge of said first plate member extends beyond an edge of said second plate member, said first plate member indexed to provide an indicia of the angular rotation of said second plate member.

8. The apparatus for mounting a radar antenna of claim 1 wherein said grip handle comprises a first arm projecting from said front surface and a grip member joined to said first arm and substantially parallel to front surface, and wherein said release handle comprises:

a second arm pivotably mounted to said controller proximal to said grip handle and adapted to overcome said spring bias and withdraw said pin to said disengaged position when pivoted.

9. The apparatus for mounting a radar antenna of claim 1 wherein said grip handle comprises a first arm projecting from said front surface and a second arm projecting from said front surface and joined to said first arm by a grip member, an inner surface of said first arm and said second arm characterized by a longitudinal channel; and a release handle slideably engaged at a first end with the inner channel of said first arm and slideably engaged at a second end with the inner channel of said second arm.

10. The apparatus for mounting a radar antenna of claim 9 wherein said first end of said release handle comprises a first pin extending through a first hole in said second plate member to removably engage said detent positions and said second end further comprises a second pin extending through a second hole in said second plate member to removable engage said detent positions when aligned therewith.

11. The apparatus for mounting a radar antenna of claim 1 wherein said platform further comprises a first control arm extending laterally there from to port and a second control arm extending laterally there from to starboard, said first linkage affixed to said first control arm and said second linkage affixed to said second control arm.

12. The apparatus for mounting a radar antenna of claim 1 further comprising a cap on said distal end of said pole and a bracket pivotably affixed to said cap wherein said platform is mounted to said bracket.

13. The apparatus for mounting a radar antenna of claim 12 wherein said bracket further comprises a first bearing surface and a second bearing surface, said first bearing surface engaging said cap to limit angular rotation of said platform in a first direction and said second bearing surface engaging said cap to limit angular rotation of said platform in a second direction.

14. The apparatus for mounting a radar antenna of claim 13 wherein said angular rotation is limited to 32 degrees in said first direction and 32 degrees in said second direction.

15. The apparatus for mounting a radar antenna of claim 1 wherein said platform is pivotably mounted to a bracket affixed to a longitudinal surface of said pole.

16. The apparatus for mounting a radar antenna of claim 15 wherein said bracket further comprises a bore housing a bearing; and wherein said platform further comprises a shaft extending there from, said shaft rotatably received and captured in said bore.

17. The apparatus for mounting a radar antenna of claim 15 further comprising a mounting plate for mounting a second antenna affixed to a cap on an end of said pole.

* * * * *